US006373386B1

(12) United States Patent
Duschek et al.

(10) Patent No.: US 6,373,386 B1
(45) Date of Patent: Apr. 16, 2002

(54) PROCESS AND DEVICE FOR PRODUCING ANTI-THEFT ELEMENTS FOR ELECTRONIC ANTI-THEFT SECURING OF ARTICLES

(75) Inventors: Detlef Duschek, Sensbachtal (DE); Gordon Klassen, Duarte, CA (US)

(73) Assignee: Meto International GmbH, Hirschhorn (DE)

( * ) Notice: Subject to any disclaimer, the term of this patent is extended or adjusted under 35 U.S.C. 154(b) by 0 days.

(21) Appl. No.: 09/284,953

(22) PCT Filed: Nov. 21, 1997

(86) PCT No.: PCT/EP97/06537

§ 371 Date: Apr. 30, 1999

§ 102(e) Date: Apr. 30, 1999

(87) PCT Pub. No.: WO98/25166

PCT Pub. Date: Jun. 11, 1998

(30) Foreign Application Priority Data

Dec. 6, 1996 (DE) ..... 196 50 611

(51) Int. Cl.[7] ..... G08B 13/14

(52) U.S. Cl. ..... 340/572.1; 340/572.8; 156/350; 156/542

(58) Field of Search ..... 340/572.1, 572.8; 156/350, 358, 362, 363, 552, 542

(56) References Cited

U.S. PATENT DOCUMENTS

| | | | | | |
|---|---|---|---|---|---|
| 4,475,969 | A | | 10/1984 | Reed | |
| 4,482,874 | A | * | 11/1984 | Rubertus et al. | 333/185 |
| 4,846,922 | A | * | 7/1989 | Benge et al. | 156/324 |
| 4,900,386 | A | | 2/1990 | Richter-Jorgensen | |
| 5,224,585 | A | * | 7/1993 | Blanco et al. | 198/803.01 |
| 5,494,550 | A | * | 2/1996 | Benge | 156/268 |
| 5,660,663 | A | * | 8/1997 | Chamberlain et al. | 156/152 |
| 5,867,102 | A | * | 2/1999 | Souder et al. | 340/572.1 |
| 6,019,865 | A | * | 2/2000 | Palmer et al. | 156/265 |
| 6,123,796 | A | * | 9/2000 | Kathmann et al. | 156/249 |
| 6,182,352 | B1 | * | 2/2001 | Deschenes et al. | 340/572.8 |

FOREIGN PATENT DOCUMENTS

| | | | | |
|---|---|---|---|---|
| DE | 1 213 071 | | 3/1966 | |
| DE | 3026482 | A1 | 2/1982 | |
| DE | 3244430 | A1 | 11/1984 | |
| DE | 2812351 | C2 | 3/1986 | |
| DE | 3601146 | A1 | 7/1987 | |
| DE | 4239846 | A1 | 6/1994 | |
| DE | 4436284 | A1 * | 10/1994 | 156/152 |
| DE | 3836480 | C2 | 6/1995 | |
| EP | 0153286 | A2 | 8/1985 | |
| EP | 0295085 | A1 | 12/1988 | |
| EP | 0319248 | A2 | 6/1989 | |
| EP | 0682333 | A1 | 11/1995 | |
| FR | 2 638 016 | | 4/1990 | |
| WO | WO 97/14126 | | 4/1997 | |

* cited by examiner

*Primary Examiner*—Nina Tong
(74) *Attorney, Agent, or Firm*—Jones, Tullar & Cooper, P.C.

(57) ABSTRACT

This invention concerns a process and device for producing anti-theft elements for electronic anti-theft securing of articles. The anti-theft elements are made of at least two layers. The invention also concerns a strip material made using the process. The aim of this invention is to present a simple, economical process, a corresponding device for producing a strip material and a strip material for securing articles electronically which is made by the process. As for the process of this invention, the aim is achieved in that segments of a predetermined length of a second web of material are fed and applied on a first continuous web of material perpendicular to the running direction said first web of material.

7 Claims, 4 Drawing Sheets

PROCESS AND DEVICE FOR PRODUCING ANTI-THEFT ELEMENTS FOR ELECTRONIC ANTI-THEFT SECURING OF ARTICLES

FIELD OF THE INVENTION

The present invention relates to a process and a device for producing protective elements for the electronic protection of objects, wherein the protective elements consist of at least two layers, as well as to an appropriate tape material.

BACKGROUND OF THE INVENTION

Goods in department stores and warehouses are electronically protected against theft in increasing numbers. A possibility of electronic theft protection consists in attaching strip elements, i.e. elongated metal pieces of low magnetic retentivity (for example VITROVAC of the firm Vacuumschmelze), to the goods. These strip elements trigger an alarm in appropriate monitoring systems, which customarily are arranged in the exit area of the protected establishment.

The electronic protection of objects can be roughly described as follows: a monitoring system has a transmitting and a receiving device. The transmitting device transmits an interrogation signal into a monitoring zone. The strip element is induced to send out a response signal, which is detected and identified by a receiving device. The appearance of the response signal is equated to the unauthorized passage of an electronically protected article through the interrogation zone, and the alarm is triggered. An example of a corresponding monitoring system is described in European Patent EP 0 123 586 A1.

Besides strip-shaped protective elements for so-called electromagnetic protection of objects, resonance protective elements are also employed. These resonance protective elements consist of a resonant circuit with capacitive and inductive elements. As soon as such a resonant circuit is subjected to an electromagnetic field within an interrogation zone, it transmits a response signal at its resonance frequency.

SUMMARY OF THE INVENTION

An object of the present invention is to provide a cost-effective, simple process, an appropriate device and a tape material, which can be produced by means of the process, for the electronic protection of objects.

In regard to the process, this object is attained in that sections of a predetermined length of a second material web are fed to a first continuous material web transversely to the running direction of the first material web, and are applied. An exemplary embodiment of tape materials produced in this manner will be cited.

The previously mentioned strip elements for the electronic protection of objects have a length of a few centimeters (for example, 3 cm). Usually labels, each containing a strip element, are made available in the form of a roll of labels and are dispensed by means of appropriate dispensing devices. If the strip elements of a few centimeter length are wound in the longitudinal direction into a roll of labels—as is customary—, a roll of labels contains only relatively few labels. This looks much different, if the strip elements are dispensed transversely to the dispensing direction. In this case the number of strip elements per roll of labels can be considerably increased.

The transverse arrangement of the strip elements brings particular advantages, if the way they are normally produced is taken into consideration: a relatively wide endless strip of a material of low magnetic retentivity is produced; subsequently, this endless strip is split into several, adjacently located endless strips of a material of low magnetic retentivity. Because of this it is possible without problems that a label, which has been applied from the side to the first material web already contains several parallel extending strip elements. By means of this it is possible to again considerably reduce the manufacturing costs for rolls of labels made up of strip elements.

In accordance with a further application example, sections of a thin film material (such materials are extensively described in European Patent, EP 0 295 028) are applied to an endless strip made of a thin film material. As a condition of manufacturing, these film materials have a preferred direction, i.e. the response signal is maximal if the interrogation field is aligned parallel with this preferred direction, while it is zero in the case of an impact perpendicular with the preferred direction. If now two layers of a thin film material are arranged perpendicularly with respect to each other, the corresponding protective element in the interrogation zone is always excited to transmit a response signal.

The process in accordance with the present invention is distinguished in that in accordance with an advantageous further development, the application of the sections of predetermined length of the second material web to the first material web can take place in steps or continuously. The higher production speed is of course an advantage of the continuous process.

With respect to the device in accordance with the present invention, the noted object is attained in that a guide device for a first material web is provided, that at least one dispensing device is provided, which is arranged perpendicularly in relation to the guide device and through which the sections of a predetermined length are fed to a second material web, and that a conveying device is provided, which successively receives the sections of predetermined length of the second material web from the dispensing device and fixes them to the first material web directly next to each other or spaced apart.

While with only a single dispensing device the application of the sections on the first material web takes place in steps, the continuous operation of the device in accordance with the present invention is possible starting with two dispensing devices. It is only required for this that the n dispensing devices are at a defined distance from each other, and that the sections are supplied at a speed which is matched to the running speed of the first material web. The speed with which the sections are supplied must be at least such that one section is already in the lateral end position in relation to the first material web when a pressure roller is moved down in order to fasten the section in the desired. longitudinal position on the first material web.

For the purpose of applying the sections to the first material web, in accordance with an advantageous further development of the device of the present invention, a pressure roller is provided transversely to the running direction of the first material web, which is designed to be movable up and down and presses the section of the predetermined length against the first material web as soon as the section has reached the preselected longitudinal position in relation to the first material web. The pressure roller remains placed against the first material web until the section, which adheres to the first material web, has been moved through underneath it.

So that the pressure roller is provided with the information as to when it is to be placed on the first material web, an advantageous embodiment of the device in accordance with the present invention proposes a stop or a sensor for detecting the correct lateral alignment (in relation to the first material web) of the sections of the second material web. The stop or sensor is connected with a control device, wherein the control device moves the pressure roller against the first material web as soon as the stop or sensor provides the information that the section of the predetermined length of the second material web has reached the predetermined position in relation to the first material web.

In order to be able to detect the correct longitudinal position (in relation to the first material web), the control device is connected, for example, with a further sensor, which detects registration markers on the first material web. In this connection it is also possible to synchronize the feeding of the sections with the running speed of the first material web in such a way that the sections are always automatically applied to the desired position on the first material web.

In accordance with an advantageous further development of the device in accordance with the present invention, n dispensing devices are provided, which are arranged at a spacing of (2n+1)*(b+z), wherein b describes the width of the sections of the second material web and z the desired spacing between two successive sections of the second material web. This embodiment makes it possible that the n dispensing devices can operate parallel with respect to each other, i.e. without a chronological offset. The control outlay is of course considerably reduced by this.

The advantages of the further development of the device in accordance with the present invention of calculating the running speed of the first material web in such a way, that the sections of predetermined length of the second material web are applied in a continuous process to the first material web, have already been previously mentioned.

An advantageous embodiment of the device in accordance with the present invention provides, that the conveying device is a conveyor belt, in relation to which a vacuum source has been arranged in such a way that the individual sections of predetermined length of the second material web are fixed on the conveyor belt at the desired spacing from each other. In this connection it is particularly advantageous, if the conveyor belt has air holes.

An alternative solution provides, that the conveying device is a conveyor belt, in relation to which at least one magnet has been arranged in such a way that the individual sections of predetermined length of the second material web are fixed on the conveyor belt at the desired spacing from each other. This is possible thanks to the magnetic properties of the materials used for the electronic protection of objects.

In accordance with an advantageous further development of the present invention, a storage roller is provided, on which the finished tape material is wound.

With respect to the tape material in accordance with the present invention, the object is attained in that the first material web is a continuous material web, on which sections of a second material web of predetermined length are supplied transversely to the running direction of the first material web and are applied.

An embodiment, which is advantageous in many actual uses proposes, that the first material web is a support material, and that the sections of predetermined length of a second material web are adhesive labels, each of which contains at least one protective element for the electronic protection of objects.

An alternative provides that the protection elements are a multitude of strip elements, which can or cannot be deactivated and which are arranged parallel in relation to each other and transversely in relation to the running direction of the first material web.

The following embodiment is also very advantageous—depending on the type of use—: the first material web is a thin film material, whose preferred direction extends transversely, or respectively parallel with the direction of running of the first material web, while the sections of predetermined length of the second material web are also thin film labels, whose preferred direction extends parallel, or respectively transversely in relation to the running direction of the first material web.

A further embodiment of the tape material in accordance with the invention proposes that the sections of predetermined length of the second material web are resonance labels.

BRIEF DESCRIPTION OF THE DRAWINGS

The present invention will be explained in greater detail by means of the following drawing figures.

DESCRIPTION OF THE PREFERRED EMBODIMENTS

Figure 1:
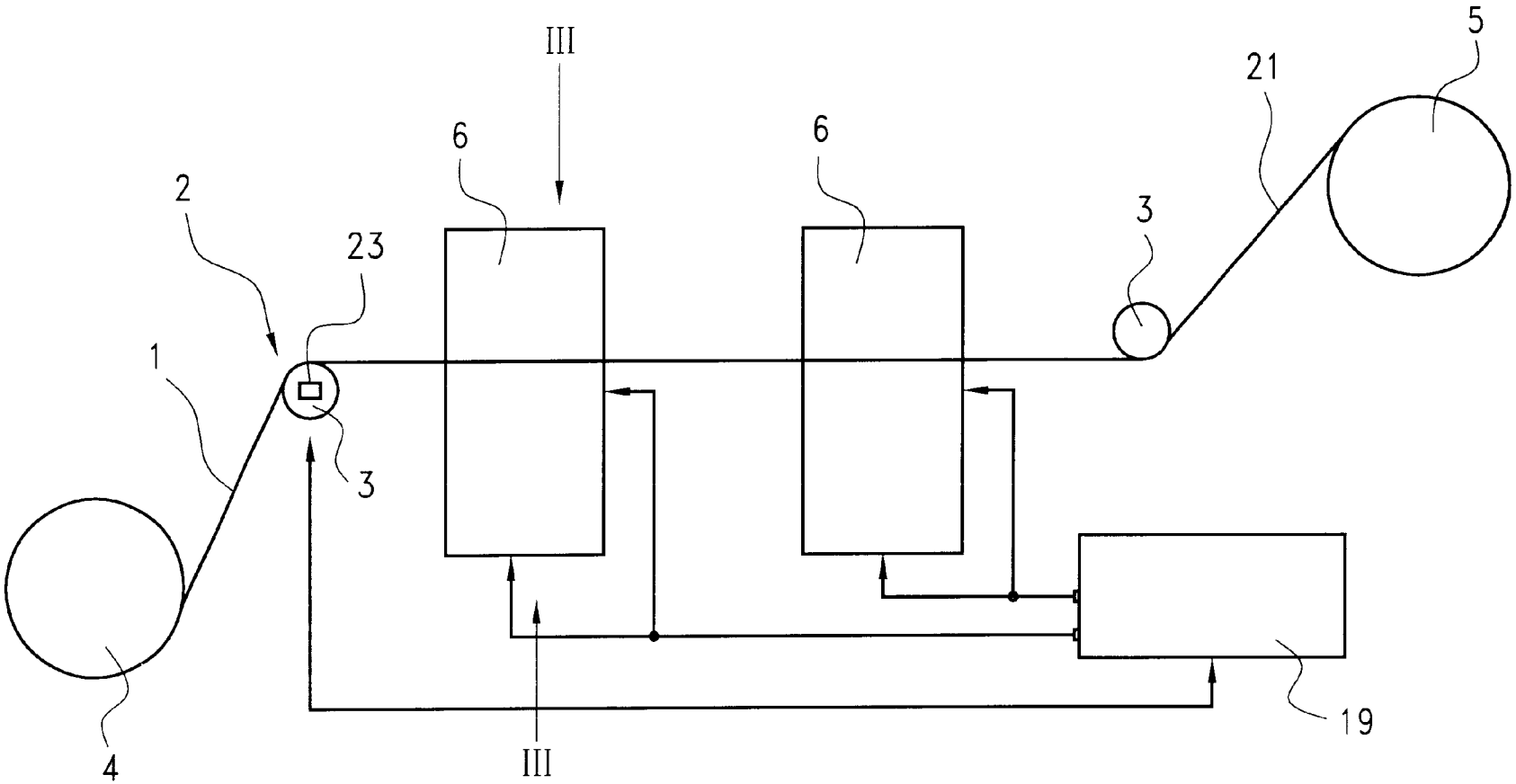
FIG. 1, is a lateral view of an embodiment of the device in accordance with the present invention.

FIG. 1 shows a lateral view of an embodiment of the device in accordance with the present invention. A first material web 1 is wound off a supply roller 4, passed via guide device 2 along the dispensing devices 6 and thereafter wound on a storage roller 5. An angle encoder 23 is arranged at the guide roller 3 of the guide device 2, which provides information regarding the running speed of the first material web 1 to the control device 19.

Figure 2:
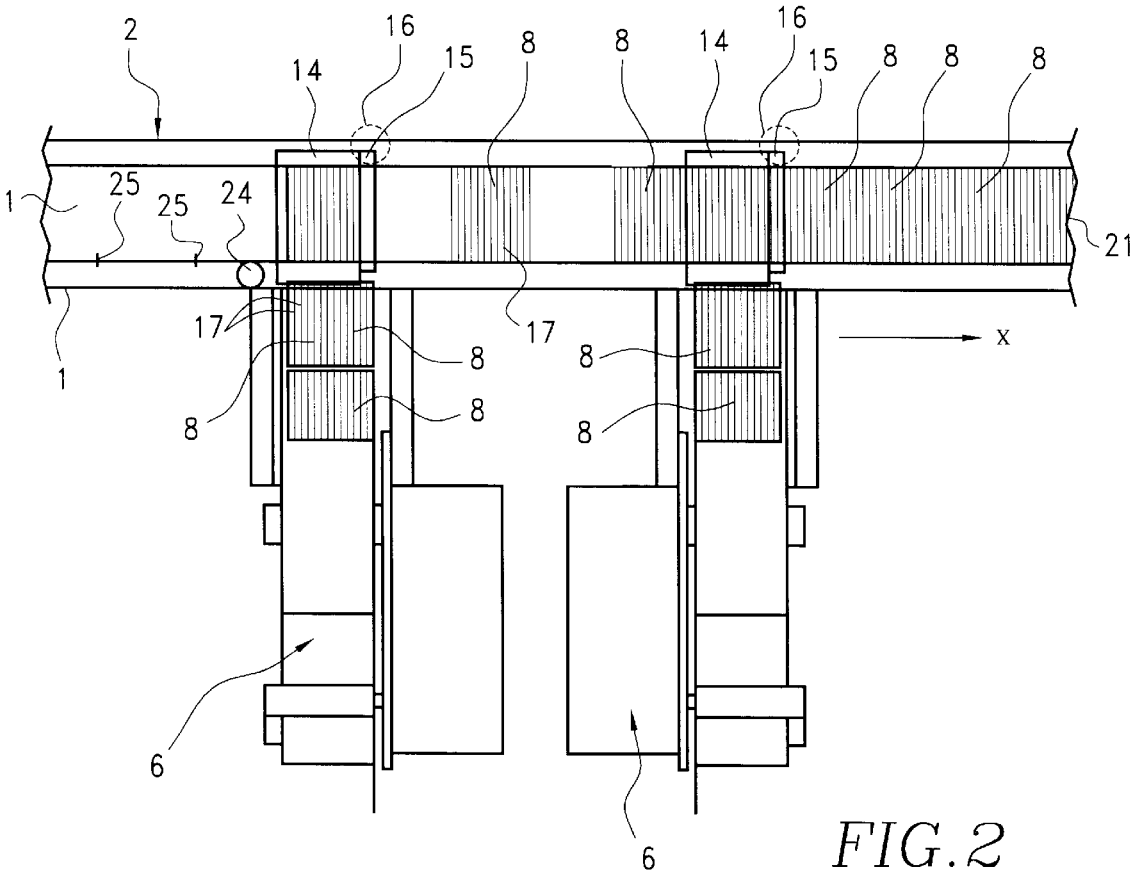
FIG. 2, is a view from above on the device in accordance with the present invention represented in FIG. 1, FIG. 3, is a cross section through the embodiment of the device in accordance with the present invention along the narrows III—III in FIG. 1, FIG. 4, is an enlarged representation of the section identified by IV in FIG. 3, FIG. 5*a,* is a view from above of a first embodiment of the tape material in accordance with the present invention, FIG. 5*b,* is a view from above of a second embodiment of the tape material in accordance with the present invention, FIG. 5*c,* is a view from above of a third embodiment of the tape material in accordance with the present invention.

FIG. 2 shows a view from above of the device in accordance with the present invention represented in FIG. 1. Sections 8 of a second material web 7 are brought into a position above the first material web 1 via the two dispensing devices 6. In the represented case, the sections 8 incidentally are several strip elements 17, arranged next to each other, per label, whose longitudinal direction is aligned transversely in relation to the running direction of the first material web 1. The sections 8 are adhesive labels in particular.

The sensors 16 provide a signal to the control device 19 as soon as a dispensed label (section 8) has reached the desired lateral alignment in relation to the first material web 1. From this time on, the section 8 is in a "ready" position. When the control device 19 receives a signal from the sensor 24 which indicates that a registration marker 25—which identifies the position in which a section 8 is to be applied to the first material web 1—has appeared in its field of view, it moves pressure rollers 15, including the sections 8 located underneath it, against the first material web 1. The pressure rollers 15 remain in this position, until the respective section 8 has been moved through underneath the pressure roller 15. The pressure roller 15 is then again lifted off the material web 1.

If both pressure rollers operate in parallel, the distance between two dispensing devices 6 is the result of the equation (2n+1)*(b+z), wherein b describes the width of the sections of the second material web 7 and z the desired spacing between two successive sections 8 of the second material web 7. The result of the production process is the tape material 21, which consists of a first material web and of sections 8, applied transversely in relation to its running direction x.

Figure 3:
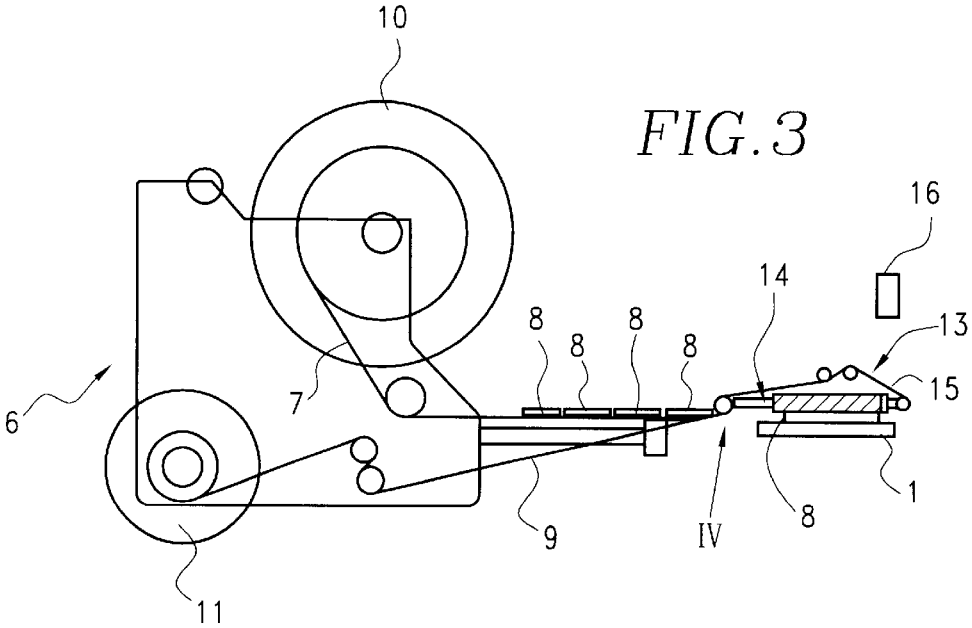

A cross section through the embodiment of the device in accordance with the present invention along the arrows III—III in FIG. 1 is represented in FIG. 3. The second tape material 7 with the sections 8 arranged one behind the other is conducted over a dispensing edge 12. Here, the individual sections 8 (adhesive labels) are removed from the support tape 9. The support tape 9 is then wound again on the storage roller 11.

The non-adhesive side of the sections 8 are taken over by the conveyor belt of the conveying device 13. Because of a speed difference between the running speed of the conveyor belt of the conveying device 13 and the speed with which the sections 8 are fed onto the conveyor belt, the distance between two successive sections 8 on the conveyor can be arbitrarily set.

Figure 4:
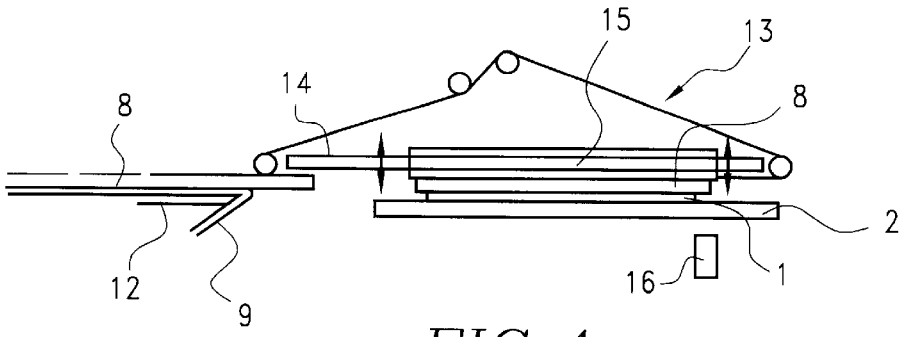

As soon as the front edge of the section 8 has reached the correct lateral alignment in relation to the running first material web 1, the sensor 17 passes a report on to the control device 19. The section 8 is in the "ready" position starting at this time. If now the dispensing device 6 also receives a report, that the correct longitudinal alignment of the section 8 in relation to the first material web 1 has also been reached, the pressure roller 15 is placed on the first material web 1 and presses the section 8 against the first material web 1. As soon as the section 8 adhering to the first material web 1 has passed underneath the pressure roller 15, the latter is lifted off the first material web 1. From this description of the device in accordance with the present invention it can be seen that it can operate continuously if at least two dispensing devices 6 are provided. Incidentally, the conveying device 13 can also be separately viewed in FIG. 4.

Figure 5A:
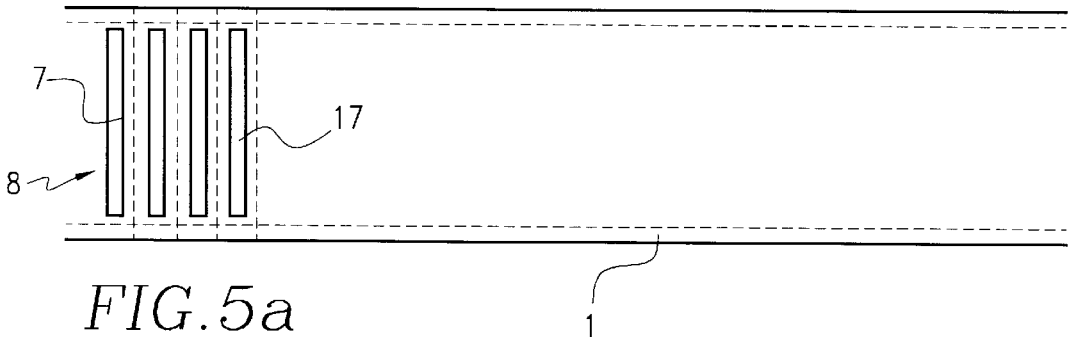

FIG. 5*a* represents a view from above of a first embodiment of the tape material 21 in accordance with the present invention. Here, the sections 8 consist—as already extensively explained above—of several strip elements 17, which are arranged parallel with each other. The first material web 1 is a support layer (for example silicon paper) for the labels.

Figure 5B:
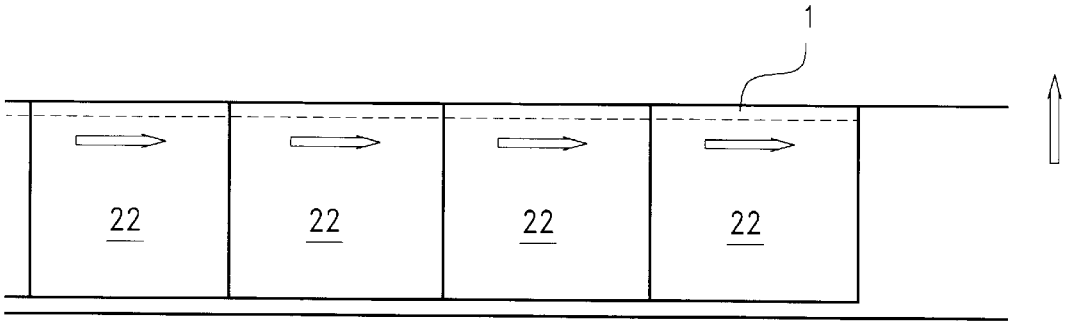

A view from above of a second embodiment of the tape material 21 in accordance with the present invention can be seen in FIG. 5*b*. Here, the first material web 1 consists of a thin film material. Because of the manufacturing process, this thin film material has a preferred direction (see the two-headed arrow) transversely in relation to the running direction x of the first material web 1. Sections 22 of a thin film material are applied to this first material web 1, whose preferred direction (see the two-headed arrow) extends parallel to the running direction x of the first material web 1 made of thin film material.

Figure 5C:
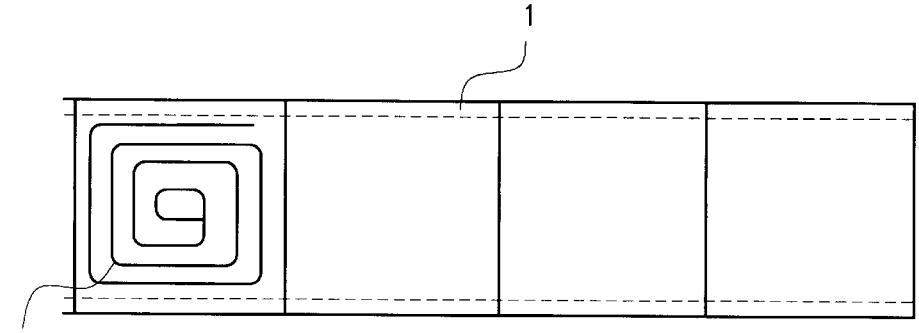

FIG. 5*c* shows a view from above of a third embodiment of the tape material 21 in accordance with the present invention. As in the first mentioned case, the first material web 1 here also consists of a support material (silicon paper). Sections 8 are applied to this support material from the side. The sections 8 are labels with resonance protection elements 18.

Figure 6:
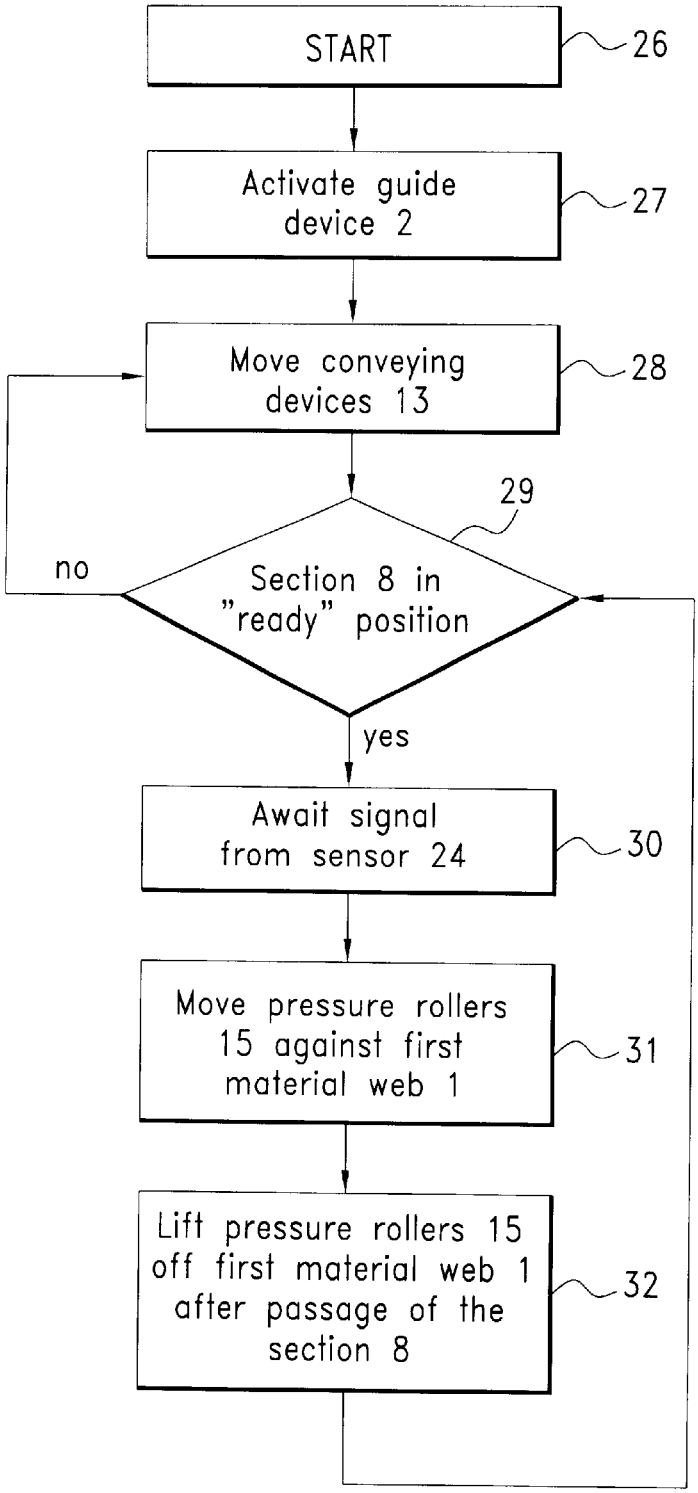
FIG. 6, is a flow diagram for controlling the device in accordance with the present invention.

A flow diagram for controlling the device in accordance with the present invention can be seen in FIG. 6. The control program is started at point 26. Incidentally, this program is suitable for a continuously operating process. At the program point 27, or respectively 28, the guide device 2 and the conveying devices 13 are activated. In the represented case, the conveying devices 13 operate in steps and are stopped as soon as the conveyed sections 8 are in the "ready" position (program point 29). If the sensor 24, which detects the registration markers 25, provides an appropriate signal at point 30, the pressure rollers 13 are placed against the first material web 1 (program point 32), until the section 8 to be fed has been passed underneath the respective pressure roller 13. Thereafter the program moves back to the program point 29.

What is claimed is:

1. A device for producing protective elements for the electronic protection of objects, the protective elements consisting of at least two layers of material web having a first material web and a second material web, the first material web defining a running direction, comprising:

a guide device for the first material web;

at least one dispensing device arranged perpendicularly to said guide device for dispensing sections of predetermined length of the second material web to the first material web;

a conveying belt for receiving the sections of predetermined length of the second material web from said at least one dispensing device;

one of a vacuum source and magnet for fixing said sections to the first material web; and a control device for controlling said conveyor belt so that said sections are successively dispensed from said at least one dispensing device and are fixed to the first material web according to one of: side by side and spaced apart transverse to the first material web.

2. The device as defined in claim 1 further comprising:

a pressure roller situated transversely to the running direction of the first material web, said pressure roller being movable up and down and presses the sections of predetermined length of the second material web against the first material web when a given section of predetermined length of the second material web reaches a preselected longitudinal position in relation to the first material web.

3. The device as defined in claim 2, further comprising:

a stop or a sensor for detecting the sections of predetermined length of the second material web; and a control device to which said stop or sensor is connected, said control device moving said pressure roller against the first material web when said stop or sensor indicates that a section of predetermined length of the second material web has reached its preselected longitudinal position.

4. The device as defined in claim 2, wherein n dispensing devices are provided, arranged at a spacing of (2n+1)*(b+z), wherein b represents the width of the sections of predetermined length of the second material web, and z represents the desired spacing between two successive sections of predetermined length of the second material web.

5. The device as defined in claim 4, wherein the running speed of the first material web is determined by said control device such that the sections of predetermined length of the second material web are applied in a continuous manner to the first material web.

6. The device as defined in claim 2, wherein said conveyor belt is provided with openings.

7. The device as defined in claim 2, further comprising:

a storage roller, wherein the first material web with the sections of predetermined length of the second material web define a finished tape material, and wherein the finished tape material is wound on said storage roller.

* * * * *